US012529489B2

(12) United States Patent
Puranen

(10) Patent No.: US 12,529,489 B2
(45) Date of Patent: Jan. 20, 2026

(54) ENHANCED HEAT PUMP DEFROST WITHOUT USE OF AUXILIARY HEAT

(71) Applicant: Rheem Manufacturing Company, Atlanta, GA (US)

(72) Inventor: Christopher Puranen, Atlanta, GA (US)

(73) Assignee: Rheem Manufacturing Company, Atlanta, GA (US)

( * ) Notice: Subject to any disclaimer, the term of this patent is extended or adjusted under 35 U.S.C. 154(b) by 195 days.

(21) Appl. No.: 18/349,421

(22) Filed: Jul. 10, 2023

(65) Prior Publication Data

US 2024/0011655 A1 Jan. 11, 2024

Related U.S. Application Data

(60) Provisional application No. 63/368,108, filed on Jul. 11, 2022.

(51) Int. Cl.
*F24F 11/42* (2018.01)
*F24F 11/63* (2018.01)
*F24F 11/72* (2018.01)

(52) U.S. Cl.
CPC ..... *F24F 11/42* (2018.01); *F24F 11/63* (2018.01); *F24F 11/72* (2018.01)

(58) Field of Classification Search
CPC .. F24F 11/41; F24F 11/42; F24F 11/43; F25B 47/02; F25B 47/022; F25B 47/025; F25B 2347/02; F25B 2347/021; F25B 2347/022; F25B 2347/023; F25B 2700/11
See application file for complete search history.

(56) References Cited

U.S. PATENT DOCUMENTS 2,229,301 A * 1/1941 Newton ..... F25B 49/022 62/226
2,242,728 A * 5/1941 Newton ..... F25B 49/02 62/226
3,170,305 A * 2/1965 Dibble ..... F25B 47/025 62/203
3,559,421 A * 2/1971 Nussbaum ..... F25B 47/022 62/278

(Continued)

FOREIGN PATENT DOCUMENTS

JP 2005274057 A * 10/2005
JP 2017040400 A * 2/2017

*Primary Examiner* — Nelson J Nieves
(74) *Attorney, Agent, or Firm* — Eversheds Sutherland (US) LLP

(57) ABSTRACT

Devices and methods for controlling a heat pump system are presented. A method may include identifying, by a first device, a signal received from a second device associated with an outdoor portion of the heat pump system, the signal indicating that the heat pump system is performing a defrost operation; reducing, based on the defrost operation, a speed of a fan associated with an indoor portion of the heat pump system; identifying pressure data received from a pressure sensor during the defrost operation, the pressure data indicative of a suction line pressure of the heat pump system; determining, based on the pressure data, that the suction line pressure is below a threshold pressure, the threshold pressure greater than a low-pressure fault threshold; and increasing the speed of the fan based on the determination that the suction line pressure is below the threshold pressure.

20 Claims, 4 Drawing Sheets

(56) References Cited

U.S. PATENT DOCUMENTS 4,901,534 A * 2/1990 Nakatsuno ..... F25B 47/022 62/81
4,944,158 A * 7/1990 Akiike ..... F25D 21/002 62/282
5,319,943 A * 6/1994 Bahel ..... F25B 47/025 62/211
6,141,978 A * 11/2000 Schuster ..... F25B 49/02 62/DIG. 17
6,334,321 B1 * 1/2002 Said ..... F25B 47/025 62/155
10,168,067 B2 * 1/2019 Gokhale ..... F25D 21/02
2005/0172648 A1 * 8/2005 Concha ..... F25B 47/022 62/183
2011/0016896 A1 * 1/2011 Oomura ..... B60H 1/321 392/347
2012/0272669 A1 * 11/2012 Blanton ..... F25D 17/06 62/89
2013/0019617 A1 * 1/2013 Hegar ..... F25B 47/022 62/81
2014/0150479 A1 * 6/2014 Qu ..... F25D 21/008 62/155
2015/0075192 A1 * 3/2015 Wasa ..... F24F 11/42 62/80
2015/0292752 A1 * 10/2015 Keith ..... F24H 15/227 62/98
2015/0330688 A1 * 11/2015 Goel ..... F25B 49/02 62/115
2016/0178261 A1 * 6/2016 Kimura ..... F25B 13/00 62/155
2016/0238271 A1 * 8/2016 Kimura ..... F25B 49/02
2016/0238297 A1 * 8/2016 Nuno ..... F25B 41/20
2017/0030621 A1 * 2/2017 Hung ..... F25B 49/02
2017/0051953 A1 * 2/2017 Dreossi ..... A47L 15/0047
2017/0328593 A1 * 11/2017 Enya ..... F24F 11/89
2018/0031289 A1 * 2/2018 Hern ..... F25B 47/025
2018/0073791 A1 * 3/2018 Sun ..... F25B 49/027
2018/0187936 A1 * 7/2018 Najima ..... F25B 49/022
2018/0238598 A1 * 8/2018 Xu ..... F25B 47/025
2018/0313592 A1 * 11/2018 Nakata ..... F24F 11/89
2019/0128590 A1 * 5/2019 Kojima ..... F25D 21/002
2019/0154322 A1 * 5/2019 Ito ..... F25B 45/00
2019/0203994 A1 * 7/2019 Nakagawa ..... F25B 47/02
2020/0049392 A1 * 2/2020 Tanaka ..... F25B 49/02
2021/0190402 A1 * 6/2021 Washiyama ..... F25B 49/02
2022/0357085 A1 * 11/2022 Sato ..... F24F 11/41
2023/0106953 A1 * 4/2023 Jovet ..... F25D 21/06 62/80
2023/0213266 A1 * 7/2023 Rizzo ..... F25D 17/06 62/89
2023/0408130 A1 * 12/2023 Boyd ..... F24F 11/65
2024/0183593 A1 * 6/2024 Kim ..... F25B 41/40
2024/0337401 A1 * 10/2024 Takahashi ..... F24F 12/002

* cited by examiner

ENHANCED HEAT PUMP DEFROST WITHOUT USE OF AUXILIARY HEAT

CROSS-REFERENCE TO RELATED PATENT APPLICATION(S)

This application claims priority to and the benefit of U.S. Provisional Application No. 63/368,108, filed on Jul. 11, 2022, the disclosure of which is hereby incorporated herein by reference in its entirety.

TECHNICAL FIELD

The present disclosure is generally in the field of heat pumps, and more particularly, the present disclosure is related to improved heat pump defrosting.

BACKGROUND

Heat pumps periodically use a defrost operation to remove frost build-up from heat exchanger coils. During a heat pump defrost operation, the heat pump reverses the refrigerant cycle, causing the outdoor coil to warm, and the indoor coil to cool down, releasing a "cold blow" of air into a home that can be undesirable.

DETAILED DESCRIPTION

Figure 1:
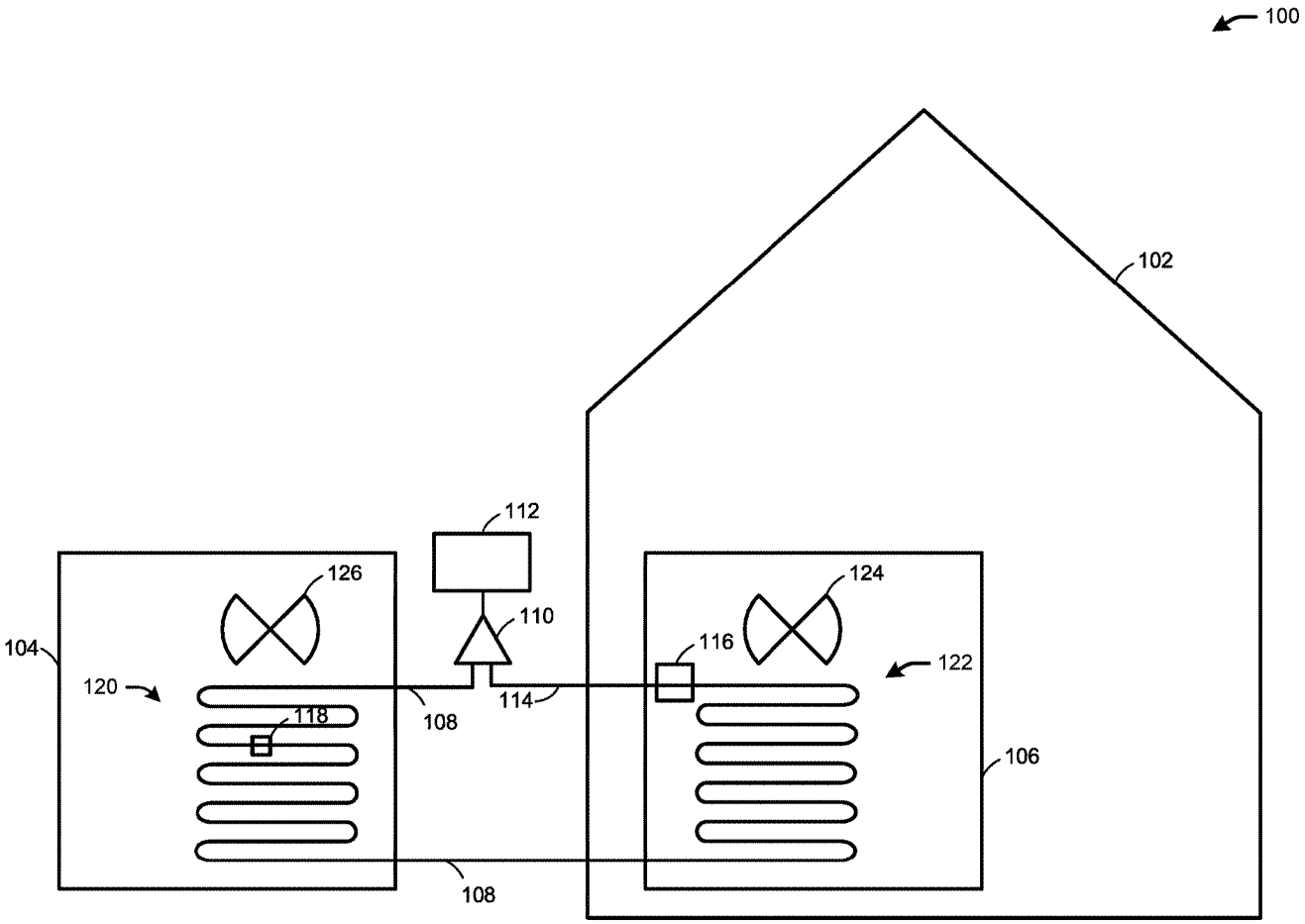
FIG. 1 is a schematic diagram illustrating a heat pump system of one embodiment of the present disclosure.

Heat pumps may be used in homes to transfer thermal energy, often as an alternative to air conditioners and furnaces. A heat pump unit may include an outdoor unit with a coil and a fan, and an indoor unit with a coil and a fan. In cold temperatures, such as during the winter season, heat pumps may operate in a heating mode that provides warm air to a home's interior by controlling the flow of refrigerant (e.g., using a valve). In cooling mode, a heat pump may pump the refrigerant through the indoor coil, as air is blown across the coils and the heat energy is absorbed by the refrigerant. As a result, cool air is blown through the home (e.g., via air ducts). In heating mode, the flow of refrigerant is reversed so that warm air is released inside the home. The refrigerant absorbs heat energy to produce a cold gas, which is pressurized into a hot gas that is cooled by the indoor unit and is condensed to a warm liquid. The warm liquid turns cool as it enters the outdoor unit.

Periodically, when the heat pump is used to produce heat, the heat pump may use a defrost operation to defrost the outdoor unit coil. During the heating cycle, as the temperature decreases outside the home, the outdoor unit works harder to absorb heat, and the outdoor unit coil may begin to frost. The periodic defrost cycle may allow a heat pump unit to temporarily defrost the outdoor coil, during which the unit enters a cooling mode, releasing cool air into the home despite the cold outdoor temperature.

During a defrost operation, some heat pump units operate the indoor blower at the indoor airflow and may lack the detection of a defrost operation to trigger an adjusted blower speed based on suction line pressure.

To reduce the impact of cold air blowing into the house, some heat pump units may use auxiliary heat, either electric heat strips or a gas furnace, to heat the cold air coming off the indoor evaporator. However, for various reasons, auxiliary heat may not be available, or it may not be set-up for use by the user. Some users may want to save energy or may not have gas available for the furnace (e.g., propane systems).

Some heat pump systems may monitor coil temperatures and adjust fan speed based on the outdoor coil temperature. However, it is important for heat pump systems to monitor suction line pressure as well. During a defrost operation, the heat pump's indoor airflow may be reduced to a minimum to counter the cold blow of indoor air during cold outdoor temperatures. However, doing so may cause refrigerant lines to lose pressure. Heat pump units may have a low-pressure fault (e.g., set at around 15 psi). When system pressure reaches the low-pressure fault, the system control may cause a lockout condition. Some heat pump systems may bypass the lockout condition when low pressure is detected during a defrost operation. However, refrigerant line pressure may continue to decrease during defrost when the indoor airflow is low.

Increasing fan speed may cause the suction line pressure to increase. However, waiting for the suction line pressure to reach the low-pressure fault before increasing fan speed may not be ideal, as the low pressure may allow for colder system temperatures.

There is therefore a need for enhanced heat pump defrost operations with variable indoor blower speed based on pressure.

In one or more embodiments, as the indoor blower slows during defrost, the suction line pressure may drop until it approaches the low-pressure fault, at which time a heat pump may increase the indoor blower speed, resulting in increased suction line pressure. By using a variable speed indoor blower and suction line sensor, the heat pump may detect, during defrost operations, when the suction line pressure drops below a threshold value (e.g., 40 psi). When the suction line pressure drops below the threshold value (e.g., a value higher than the low-pressure fault value), the heat pump may increase the speed of the indoor blower (e.g., a linear speed increase) to the normal heating airflow as the suction line pressure falls toward the low-pressure fault value.

In one or more embodiments, for the indoor unit to detect that the outdoor unit is in a defrost mode, the indoor unit may communicate with the outdoor unit. For example, processing and communications hardware may be included in an indoor thermostat or at the indoor unit to identify a received defrost mode signal sent by the outdoor unit. The defrost mode signal may trigger the indoor unit to reduce the indoor blower speed and monitor the suction line pressure, increasing the indoor blower speed as the suction line pressure drops below the threshold value.

In one or more embodiments, a user may have the option to use or not use the defrost mode enhancement. For example, a setting at the thermostat or indoor unit may allow the user to select whether to allow a defrost operation with or without the enhanced indoor blower settings.

The enhancements of the present disclosure may reduce cold blow during heat pump defrost cycles, and may reduce or avoid the need for auxiliary heat sources to reduce the impact of cold blow.

Modifications and variations of the methods and devices described herein will be obvious to those skilled in the art from the foregoing detailed description. Such modifications and variations are intended to come within the scope of the appended claims.

FIG. 1 is a schematic diagram illustrating a heat pump system 100 of one embodiment of the present disclosure.

Referring to FIG. 1, the heat pump system 100 may be used to heat and cool a building 102. The heat pump system 100 may include an outdoor unit 104 and an indoor unit 106 connected by refrigerant lines 108. The heat pump system 100 may have a reversing valve 110 to control the direction of the flow of refrigerant through the refrigerant lines 108. By reversing the flow direction with the reversing valve 110, the heat pump system 100 can be configured to cool the building 102 rather than heat the building 102. Additionally, opening the reversing valve 110 while the heat pump system 100 is no longer operating in a heating mode can allow residual heat in the refrigerant to reach the outdoor unit 104.

Still referring to FIG. 1, the heat pump system 100 may include a compressor 112 for compressing the refrigerant. When in a cooling mode (e.g., during a defrost operation), the portion of the refrigerant lines 108 between the indoor unit 106 and the compressor 112 may be referred to as a suction line 114. To measure the pressure of the suction line 114, the heat pump system 100 may include a suction line pressure sensor 116 (e.g., within the indoor unit 106 or elsewhere). The outdoor unit 104 may include a coil temperature sensor 118 to measure the temperature of an outdoor coil 120 (e.g., to detect when the temperature is below a temperature threshold and trigger a defrost operation). The indoor unit 106 may have an indoor coil 122 and a fan 124. The outdoor unit 104 may include a fan 126.

The heat pump system 100 may warm the building 102 by moving heat from outside the building 102 to inside the building 102 through a vapor-compression cycle. During this process, it is common for the temperature of the outdoor coil 120 in the outdoor unit 104 to fall below the temperature of the ambient, air causing moisture in the air to condense on the outdoor coil 120. When the outdoor coil 120 temperature falls below freezing, the condensation accumulated on the outdoor coil 120 may freeze, causing a buildup of frost and ice. This is particularly common in regions of the world with a humid climate and cool air temperature where heat pump systems 100 are operated to heat buildings 102 for extended periods of time. In these conditions, frost can accumulate to the point where the heat pump system 100 operates with a degraded performance or components become damaged. To counter the frost build-up on the outdoor coil 120, the heat pump system 100 may enter a defrost cycle in which the reversing valve 110 may reverse the flow of the refrigerant so that the heat pump system 100 operates in a cooling mode, allowing heat in the outdoor unit 104 to defrost the outdoor coil 120. During the cooling mode, cool air may blow inside the building 102 from the indoor unit 106.

The outdoor coil 120 may be any type of evaporator coil used in a heat pump system 100, including, but not limited to, bare tube, plate-type, and finned evaporator coils. Although the disclosed technology is described in the context of being for application in outdoor evaporator units used to heat a building, the disclosed technology can be used in any evaporator unit where the evaporator coil temperature falls below the freezing temperature of the surrounding fluid and the ambient fluid temperature remains above the freezing temperature of the fluid.

Figure 2:
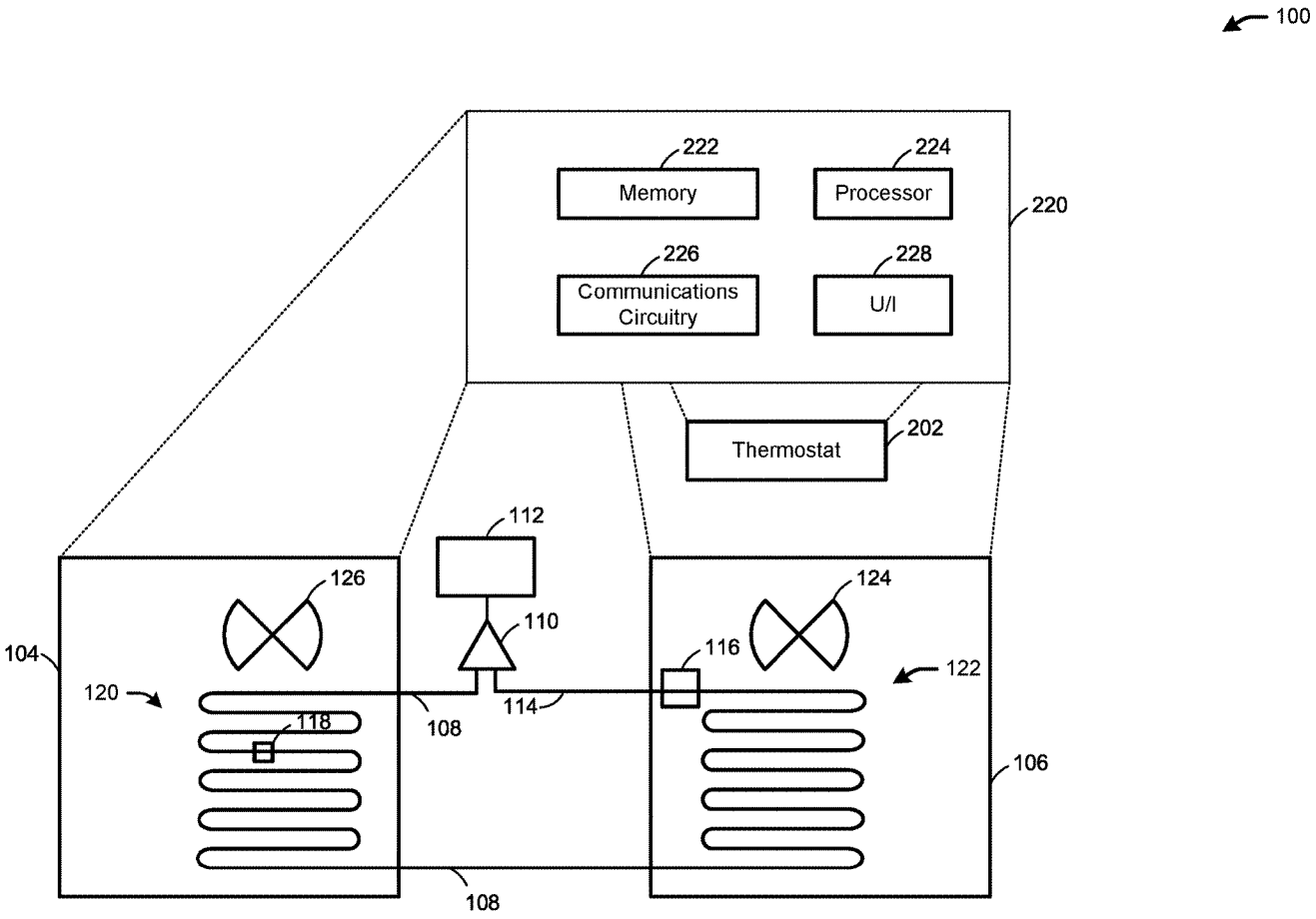
FIG. 2 is a schematic diagram illustrating components of the heat pump system of FIG. 1 of one embodiment of the present disclosure.

To determine the temperature of the outdoor coil 120, the coil temperature sensor 118 may detect the temperature of the outdoor coil 120 and output the detected temperature (e.g., to a controller as shown in FIG. 2). The coil temperature sensor 118 may detect the temperature of the outdoor coil 120 continuously or periodically when the heat pump system 100 is shut down, while the heat pump system 100 is operating, or both. The coil temperature sensor 118 may be installed directly on the surface of the outdoor coil 120, inside of the outdoor coil 120 partially inside of the outdoor coil 120, or near the outdoor coil 120. Additionally, the coil temperature sensor 118 may measure the surface temperature, the core temperature, a temperature of a portion of the outdoor coil 120, or any other method of measuring as would be suitable for the particular application and arrangement. The coil temperature sensor 118 may include any type of sensor capable of measuring the temperature of the outdoor coil 120. For example, the temperature sensor 118 can be or include a thermocouple, a resistor temperature detector (RTD), a thermistor, an infrared sensor, a semiconductor, or any other suitable type of sensor for the application.

The fan 124 and the fan 126 may be any type of fan configured to direct air across at least a portion the outdoor coil 120 and the indoor coil 122, respectively. The fan 124 and the fan 126, for example, may be an axial-flow fan, a centrifugal fan, a crossflow fan, or any other type of fan suitable for the application. The fan 124 may be the same fan used to operate the outdoor unit 104 or the fan 124 may be a separate fan installed specifically to direct air across the outdoor coil 120 to reduce frost buildup. The fan 124 may also be coupled with a variable-speed motor to adjust the speed based on the pressure of the suction line 114. Furthermore, in applications where the 124 and the fan 126 is surrounded by a fluid other than air, the fan 124 alternatively may be an impeller, propeller, pump, or any other fluid moving device suitable for the application.

FIG. 2 is a schematic diagram illustrating components of the heat pump system 100 of FIG. 1 of one embodiment of the present disclosure.

Referring to FIG. 2, the heat pump system 100 may have one or more thermostats 202 (e.g., inside of the building 102 of FIG. 1) with which users may set the temperatures, heating and cooling modes, and defrost modes of the heat pump system 100. Any of the outdoor unit 104, the indoor unit 106, and/or the one or more thermostats 202 may include a respective controller 220. The controller 220 may include memory 222 and a processor 224.

The controller 220 may be a computing device to receive data, determine actions based on the received data, and output a control signal instructing one or more components of the heat pump system 100 to perform one or more actions. The controller 220 may be installed in any location, provided the controller 220 is in communication with at least some of the components of the heat pump system 100. Furthermore, the controller 220 may send and receive wireless or wired signals and the signals can be analog or digital signals. The wireless signals can include serial, Bluetooth™, BLE, WiFi™, ZigBee™, infrared, microwave radio, or any other type of wireless communication as may be appropriate for the particular application. The hard-wired signal can include any directly wired connection between the controller and the other components. For example, the controller 220 may have a hard-wired 24 VDC connection to the coil temperature sensor 118. Alternatively, the components may be powered directly from a power source and receive control instructions from the controller 220 via a digital connection. The digital connection can include a connection such as an Ethernet or a serial connection and can utilize any appropriate communication protocol for the application such as Modbus, fieldbus, PROFIBUS, SafetyBus, Ethernet/IP, or any other appropriate communication protocol for the application. Furthermore, the controller 220 may utilize a combination of wireless, hard-wired, and analog or digital communication signals to communicate with and control the various components. One of skill in the art will appreciate that the above configurations are given merely as non-limiting examples and the actual configuration can vary depending on the application.

The controller 220 can include a memory 222 that may store a program and/or instructions associated with the functions and methods described herein and can include one or more processors 224 configured to execute the program and/or instructions. The memory 222 may include one or more suitable types of memory (e.g., volatile or non-volatile memory, random access memory (RAM), read only memory (ROM), programmable read-only memory (PROM), erasable programmable read-only memory (EPROM), electrically erasable programmable read-only memory (EEPROM), magnetic disks, optical disks, floppy disks, hard disks, removable cartridges, flash memory, a redundant array of independent disks (RAID), and the like) for storing files including the operating system, application programs (including, for example, a web browser application, a widget or gadget engine, and or other applications, as necessary), executable instructions and data. One, some, or all of the processing techniques described herein may be implemented as a combination of executable instructions and data within the memory.

The controller 220 may also have a communication circuitry 226 for sending and receiving communication signals between the various components. Communication circuitry 226 may include hardware, firmware, and/or software that allows the processor(s) 224 to communicate with the other components via wired or wireless networks, whether local or wide area, private or public, as known in the art. Communication circuitry 226 may also provide access to a cellular network, the Internet, a local area network, or another wide-area network as suitable for the particular application.

Additionally, the controller 220 may have a user interface 228 for displaying system information and receiving inputs from a user. The user, for example, may input data to set the temperature range, threshold temperature, humidity range, and length of time the fan is configured to run after the heat pump heating system has shut down. The user interface 228 may be installed locally on the outdoor unit 104, inside the building 102, or be a remote-control device such as a mobile device.

The system for reducing frost accumulation on the outdoor unit 104 may operate by the controller 220 receiving inputs from the coil temperature sensor 118, and determining whether to send a control signal to run the fan 126. The controller 220 may use the inputs from the coil temperature sensor 118, for example, to determine if the temperature of the outdoor coil 120 has fallen below a threshold temperature. The threshold temperature can be the freezing temperature of water (i.e., 32° F.), a temperature above the freezing temperature of water (e.g., 35° F.), or a temperature below the freezing temperature of water (e.g., 29° F.), or any other suitable threshold temperature for the application.

The controller 220 also may consider a user input selecting whether to use a pressure-based variable speed of the fan 126 during a defrost cycle. A controller 220 of the thermostat 202 or the indoor unit 106 may receive, from a controller 220 of the outdoor unit 104 (e.g., using serial or other communications), a defrost mode signal indicating that the outdoor unit 104 is initiating a defrost cycle. Based on the defrost mode signal, the controller 220 of the thermostat 202 or the indoor unit 106 may receive pressure readings from the suction line pressure sensor 116. During defrost, the controller 220 of the thermostat 202 or the indoor unit 106 may reduce the blower speed of the indoor fan 124 until the pressure of the suction line 114 drops below a pressure threshold (e.g., higher than a low-pressure fault threshold). When the pressure of the suction line 114 drops below the pressure threshold, the controller 220 of the thermostat 202 or the indoor unit 106 may begin to increase (e.g., linearly) the speed of the fan 124 to combat cold blow inside the building 102. For example, the controller 220 of the thermostat 202 or the indoor unit 106 may increase the speed of the fan 124 to a normal (e.g., non-defrost level) airflow as the pressure of the suction line 114 falls to the low-pressure fault threshold. In this manner, the speed of the fan 124 may vary as the pressure of the suction line 114 falls below the pressure threshold and to the low-pressure fault threshold. When the pressure of the suction line 114 is detected as above the pressure threshold during defrost, the controller 220 of the thermostat 202 or the indoor unit 106 may reduce the speed of the fan 124 again.

When the fan 126 is coupled to a variable-speed motor, the controller 220 may run the fan 126 at a lower capacity than when the fan is operating normally. For example, the fan 126 can operate at 100% capacity while the heat pump system 100 is operating, and then continue to operate at 35% capacity to defrost the outdoor coil 120 after the heat pump system 100 is shut down. Doing so will conserve energy and reduce the frost accumulation with less noise providing for a more pleasing experience for a user. In this configuration, the controller 220 may operate the fan 126 at various capacities depending on the conditions detected by the coil temperature sensor 118 and the suction line 114 pressure sensor 116.

Figure 3:
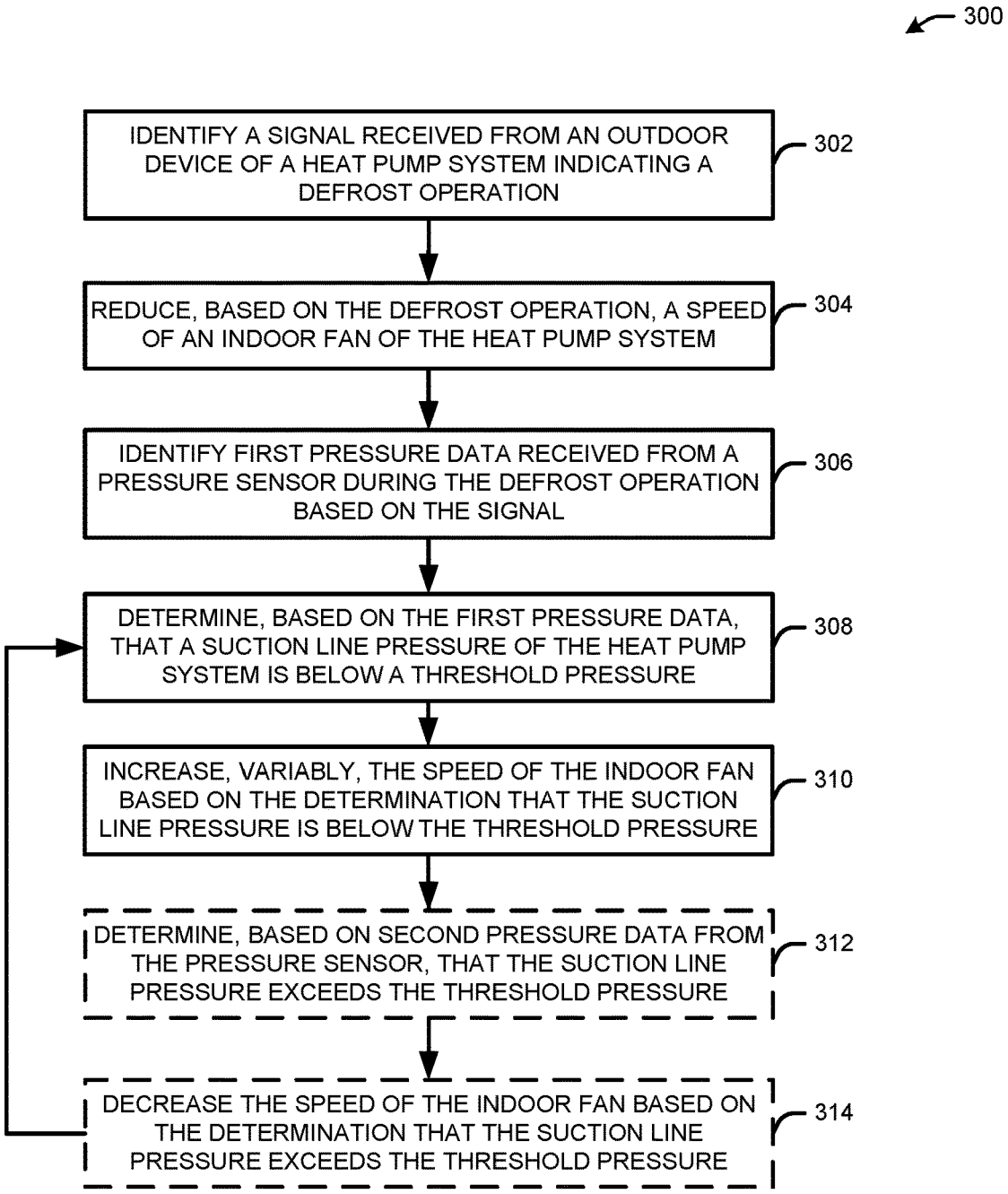
FIG. 3 is a flow diagram illustrating an example process of a heat pump defrost operation of one embodiment of the present disclosure.

FIG. 3 is a flow diagram illustrating an example process 300 of a heat pump defrost operation of one embodiment of the present disclosure.

At block 302, a device (or system, e.g., the controller 220 of the thermostat 202 or the indoor unit 106 of FIG. 1) of a heat pump system may identify a signal received from an outdoor portion of a heat pump system (e.g., the outdoor unit 104 of FIG. 1). The device may be indoors and in communication with an outdoor portion of the heat pump system. When the outdoor portion of the heat pump system initiates a defrost operation (e.g., based on a detected temperature being below a temperature threshold), the outdoor portion may generate and send (e.g., using the controller 220 when implemented in the outdoor unit 104) a signal indicating the execution of the defrost cycle. The defrost cycle may cause the outdoor portion to heat its coils, resulting in cool air being released at the indoor portion of the heat pump system.

At block 304, the device may reduce, based on the received signal indicating the defrost operation, a speed of an indoor fan (e.g., the fan 124 of FIG. 1) to reduce the cool air that may be blown indoors as a result of the defrost operation. However, as a result, the suction line pressure of the heat pump system may drop. During the defrost operation, the heat pump system may activate one or more pressure sensors and/or initiate monitoring of pressure data from the pressure sensors to prevent the pressure from becoming too low and tripping a low-pressure fault, for example. The device may send control signals to the indoor fan to control the fan speed.

At block 306, the device may identify first pressure data received from a pressure sensor (e.g., the pressure sensor 116 of FIG. 1). The pressure data may indicate pressure in refrigerant lines, such as the suction line 114 of the heat pump system. When the suction line pressure reaches a low-pressure fault, a locking may be triggered or avoided, and the exterior coil temperature may drop (e.g., to freezing temperature or below). Therefore, the device may set a threshold pressure above the low-pressure fault to prevent the pressure and temperature from going too low.

At block 308, the device may determine, based on the first pressure data, that a suction line pressure of the heat pump system is below the threshold pressure. While the suction line pressure is above the threshold pressure, the device may leave the indoor fan speed at the reduced level. However, when the suction line pressure drops below the threshold pressure, the device may trigger a variable fan speed increase for the indoor fan to increase suction line pressure. The result of the variable speed increase for the indoor fan is cool air blowing inside, which may be undesirable in cold temperatures. Therefore, the device may increase the indoor fan speed in a controlled manner in concert with the suction line pressure.

At block 310, the device may increase the speed of the indoor fan when the suction line pressure is below the threshold pressure. The speed increase may vary (e.g., linearly) so that the fan blows at a slightly faster rate that increases over time during the defrost as the suction line pressure is below the threshold pressure. The variable rate increase may manage the cold blow caused by rotation of the indoor fan during defrost. The device may send control signals to the indoor fan to control the fan speed.

At block 312, optionally, the device may determine, based on second pressure data received from the pressure sensor (e.g., at a time later than the first pressure data was received), that the suction line pressure has risen to a level that exceeds the threshold pressure (e.g., as a result of the indoor fan speed increase during defrost).

At block 314, optionally, the device may decrease the indoor fan speed based on the determination that the suction line pressure has risen to a level that exceeds the threshold pressure. In this manner, if the variable speed increase of the indoor fan causes the suction line pressure to rise above the threshold pressure, the device may again slow the indoor fan speed to mitigate cold blow indoors.

Figure 4:
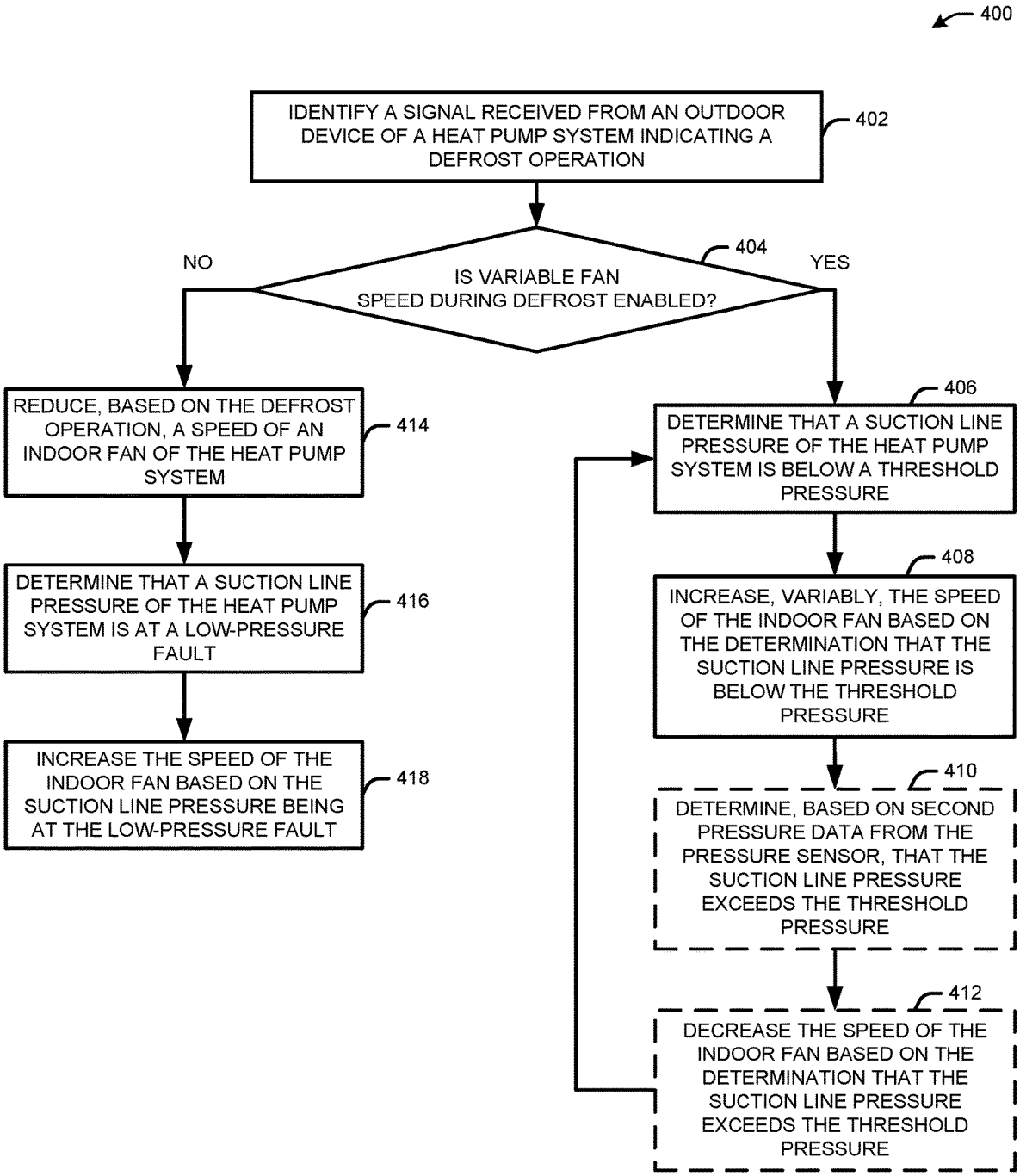
FIG. 4 is a flow diagram illustrating an example process of a heat pump defrost operation of one embodiment of the present disclosure.

FIG. 4 is a flow diagram illustrating an example process 400 of a heat pump defrost operation of one embodiment of the present disclosure.

At block 402, a device (or system, e.g., the controller 220 of the thermostat 202 or the indoor unit 106 of FIG. 1) of a heat pump system may identify a signal received from an outdoor portion of a heat pump system (e.g., the outdoor unit 104 of FIG. 1). The device may be indoors and in communication with an outdoor portion of the heat pump system. When the outdoor portion of the heat pump system initiates a defrost operation (e.g., based on a detected temperature being below a temperature threshold), the outdoor portion may generate and send (e.g., using the controller 220 when implemented in the outdoor unit 104) a signal indicating the execution of the defrost cycle. The defrost cycle may cause the outdoor portion to heat its coils, resulting in cool air being released at the indoor portion of the heat pump system.

At block 404, the device may determine whether a user setting (e.g., a user input) allows for enabling a variable indoor fan speed control during defrost. For example, some users may rely on auxiliary heating elements at the indoor portion of the heat pump system to heat cold air released indoor as a result of the defrost operation, and such users may deactivate the variable fan speed control. The user input may include a selection to enable or disable the variable fan speed control, or may include a setting indicating whether the user has an auxiliary heating element at the indoor unit.

At block 406, when the variable fan speed during defrost option is enabled, the device may determine, based on the first pressure data, that a suction line pressure of the heat pump system is below the threshold pressure. While the suction line pressure is above the threshold pressure, the device may leave the indoor fan speed at the reduced level. However, when the suction line pressure drops below the threshold pressure, the device may trigger a variable fan speed increase for the indoor fan to increase suction line pressure. The result of the variable speed increase for the indoor fan is cool air blowing inside, which may be undesirable in cold temperatures. Therefore, the device may increase the indoor fan speed in a controlled manner in concert with the suction line pressure.

At block 408, the device may increase the speed of the indoor fan when the suction line pressure is below the threshold pressure. The speed increase may vary (e.g., linearly) so that the fan blows at a slightly faster rate that increases over time during the defrost as the suction line pressure is below the threshold pressure. The variable rate increase may manage the cold blow caused by rotation of the indoor fan during defrost. The device may send control signals to the indoor fan to control the fan speed.

At block 410, optionally, the device may determine, based on second pressure data received from the pressure sensor (e.g., at a time later than the first pressure data was received), that the suction line pressure has risen to a level that exceeds the threshold pressure (e.g., as a result of the indoor fan speed increase during defrost).

At block 412, optionally, the device may decrease the indoor fan speed based on the determination that the suction line pressure has risen to a level that exceeds the threshold pressure. In this manner, if the variable speed increase of the indoor fan causes the suction line pressure to rise above the threshold pressure, the device may again slow the indoor fan speed to mitigate cold blow indoors.

At block 414, when the variable fan speed during defrost option is enabled, the device may reduce the indoor fan speed during the defrost. The result may be a decrease in suction line pressure.

At block 416, the device may detect a low-pressure fault in the suction line pressure (or in some other refrigerant line pressure). The low-pressure fault may be lower than the pressure threshold.

At block 418, the device may increase the indoor fan speed to increase the pressure in the heat pump system.

The description above is not meant to be limiting.

Embodiments according to the disclosure are in particular disclosed in the attached claims directed to a method, a storage medium, a device and a computer program product, wherein any feature mentioned in one claim category, e.g., method, can be claimed in another claim category, e.g., system, as well. The dependencies or references back in the attached claims are chosen for formal reasons only. However, any subject matter resulting from a deliberate reference back to any previous claims (in particular multiple dependencies) can be claimed as well, so that any combination of claims and the features thereof are disclosed and can be claimed regardless of the dependencies chosen in the attached claims. The subject-matter which can be claimed comprises not only the combinations of features as set out in the attached claims but also any other combination of features in the claims, wherein each feature mentioned in the claims can be combined with any other feature or combination of other features in the claims. Furthermore, any of the embodiments and features described or depicted herein can be claimed in a separate claim and/or in any combination with any embodiment or feature described or depicted herein or with any of the features of the attached claims.

The foregoing description of one or more implementations provides illustration and description, but is not intended to be exhaustive or to limit the scope of embodiments to the precise form disclosed. Modifications and variations are possible in light of the above teachings or may be acquired from practice of various embodiments.

Certain aspects of the disclosure are described above with reference to block and flow diagrams of systems, methods, apparatuses, and/or computer program products according to various implementations. It will be understood that one or more blocks of the block diagrams and flow diagrams, and combinations of blocks in the block diagrams and the flow diagrams, respectively, may be implemented by computer-executable program instructions. Likewise, some blocks of the block diagrams and flow diagrams may not necessarily need to be performed in the order presented, or may not necessarily need to be performed at all, according to some implementations.

These computer-executable program instructions may be loaded onto a special-purpose computer or other particular machine, a processor, or other programmable data processing apparatus to produce a particular machine, such that the instructions that execute on the computer, processor, or other programmable data processing apparatus create means for implementing one or more functions specified in the flow diagram block or blocks. These computer program instructions may also be stored in a computer-readable storage media or memory that may direct a computer or other programmable data processing apparatus to function in a particular manner, such that the instructions stored in the computer-readable storage media produce an article of manufacture including instruction means that implement one or more functions specified in the flow diagram block or blocks. As an example, certain implementations may provide for a computer program product, comprising a computer-readable storage medium having a computer-readable program code or program instructions implemented therein, said computer-readable program code adapted to be executed to implement one or more functions specified in the flow diagram block or blocks. The computer program instructions may also be loaded onto a computer or other programmable data processing apparatus to cause a series of operational elements or steps to be performed on the computer or other programmable apparatus to produce a computer-implemented process such that the instructions that execute on the computer or other programmable apparatus provide elements or steps for implementing the functions specified in the flow diagram block or blocks.

Accordingly, blocks of the block diagrams and flow diagrams support combinations of means for performing the specified functions, combinations of elements or steps for performing the specified functions and program instruction means for performing the specified functions. It will also be understood that each block of the block diagrams and flow diagrams, and combinations of blocks in the block diagrams and flow diagrams, may be implemented by special-purpose, hardware-based computer systems that perform the specified functions, elements or steps, or combinations of special-purpose hardware and computer instructions.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language is not generally intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

For the purposes of the present document, the following terms and definitions are applicable to the examples and embodiments discussed herein.

The term "circuitry" as used herein refers to, is part of, or includes hardware components such as an electronic circuit, a logic circuit, a processor (shared, dedicated, or group) and/or memory (shared, dedicated, or group), an Application Specific Integrated Circuit (ASIC), a field-programmable device (FPD) (e.g., a field-programmable gate array (FPGA), a programmable logic device (PLD), a complex PLD (CPLD), a high-capacity PLD (HCPLD), a structured ASIC, or a programmable SoC), digital signal processors (DSPs), etc., that are configured to provide the described functionality. In some embodiments, the circuitry may execute one or more software or firmware programs to provide at least some of the described functionality. The term "circuitry" may also refer to a combination of one or more hardware elements (or a combination of circuits used in an electrical or electronic system) with the program code used to carry out the functionality of that program code. In these embodiments, the combination of hardware elements and program code may be referred to as a particular type of circuitry.

The term "processor circuitry" as used herein refers to, is part of, or includes circuitry capable of sequentially and automatically carrying out a sequence of arithmetic or logical operations, or recording, storing, and/or transferring digital data. Processing circuitry may include one or more processing cores to execute instructions and one or more memory structures to store program and data information. The term "processor circuitry" may refer to one or more application processors, one or more baseband processors, a physical central processing unit (CPU), a single-core processor, a dual-core processor, a triple-core processor, a quad-core processor, and/or any other device capable of executing or otherwise operating computer-executable instructions, such as program code, software modules, and/or functional processes. Processing circuitry may include more hardware accelerators, which may be microprocessors, programmable processing devices, or the like. The one or more hardware accelerators may include, for example, computer vision (CV) and/or deep learning (DL) accelerators. The terms "application circuitry" and/or "baseband circuitry" may be considered synonymous to, and may be referred to as, "processor circuitry."

The term "interface circuitry" as used herein refers to, is part of, or includes circuitry that enables the exchange of information between two or more components or devices. The term "interface circuitry" may refer to one or more hardware interfaces, for example, buses, I/O interfaces, peripheral component interfaces, network interface cards, and/or the like.

The term "computer system" as used herein refers to any type interconnected electronic devices, computer devices, or components thereof. Additionally, the term "computer system" and/or "system" may refer to various components of a computer that are communicatively coupled with one another. Furthermore, the term "computer system" and/or "system" may refer to multiple computer devices and/or multiple computing systems that are communicatively coupled with one another and configured to share computing and/or networking resources.

The term "appliance," "computer appliance," or the like, as used herein refers to a computer device or computer system with program code (e.g., software or firmware) that is specifically designed to provide a specific computing resource. A "virtual appliance" is a virtual machine image to be implemented by a hypervisor-equipped device that virtualizes or emulates a computer appliance or otherwise is dedicated to provide a specific computing resource.

The term "resource" as used herein refers to a physical or virtual device, a physical or virtual component within a computing environment, and/or a physical or virtual component within a particular device, such as computer devices, mechanical devices, memory space, processor/CPU time, processor/CPU usage, processor and accelerator loads, hardware time or usage, electrical power, input/output operations, ports or network sockets, channel/link allocation, throughput, memory usage, storage, network, database and applications, workload units, and/or the like. A "hardware resource" may refer to compute, storage, and/or network resources provided by physical hardware element(s). A "virtualized resource" may refer to compute, storage, and/or network resources provided by virtualization infrastructure to an application, device, system, etc. The term "network resource" or "communication resource" may refer to resources that are accessible by computer devices/systems via a communications network. The term "system resources" may refer to any kind of shared entities to provide services, and may include computing and/or network resources. System resources may be considered as a set of coherent functions, network data objects or services, accessible through a server where such system resources reside on a single host or multiple hosts and are clearly identifiable.

The terms "instantiate," "instantiation," and the like as used herein refers to the creation of an instance. An "instance" also refers to a concrete occurrence of an object, which may occur, for example, during execution of program code.

The terms "coupled," "communicatively coupled," along with derivatives thereof are used herein. The term "coupled" may mean two or more elements are in direct physical or electrical contact with one another, may mean that two or more elements indirectly contact each other but still cooperate or interact with each other, and/or may mean that one or more other elements are coupled or connected between the elements that are said to be coupled with each other. The term "directly coupled" may mean that two or more elements are in direct contact with one another. The term "communicatively coupled" may mean that two or more elements may be in contact with one another by a means of communication including through a wire or other interconnect connection, through a wireless communication channel or link, and/or the like.

What is claimed is:

1. A method for controlling a heat pump system, the method comprising:

identifying, by at least one processor of a first device, a signal received from a second device associated with an outdoor portion of the heat pump system, the signal indicating that the heat pump system is performing a defrost operation;

reducing, by the at least one processor, based on the defrost operation, a speed of a fan associated with an indoor portion of the heat pump system;

identifying, by the at least one processor, pressure data received from a pressure sensor during the defrost operation, the pressure data indicative of a suction line pressure of the heat pump system;

determining, by the at least one processor, based on the pressure data, that the suction line pressure is below a threshold pressure during the defrost operation, the threshold pressure greater than a low-pressure fault threshold; and increasing, by the at least one processor, the speed of the fan based on the determination that the suction line pressure is below the threshold pressure during the defrost operation.

2. The method of claim 1, wherein increasing the speed of the fan comprises increasing the speed of the fan linearly, based on the suction line pressure being below the threshold pressure during the defrost operation, to a second speed associated with a heating operation of the heat pump system.

3. The method of claim 1, further comprising:

determining, based on the pressure data, that the suction line pressure is above the threshold pressure; and reducing the speed of the fan based on the determination that the suction line pressure is above the threshold pressure.

4. The method of claim 1, wherein the first device is an indoor thermostat device.

5. The method of claim 1, wherein the first device is in the indoor portion of the heat pump system.

6. The method of claim 1, wherein the fan comprises a variable speed blower associated with increasing the speed of the fan at multiple speeds based on the determination that the suction line pressure is below the threshold pressure during the defrost operation, and wherein reducing the speed of the fan comprises reducing the speed of the fan to a speed greater than zero.

7. The method of claim 1, further comprising activating, based on the defrost operation, monitoring of the pressure data.

8. The method of claim 1, wherein the signal is received serially from the second device.

9. The method of claim 1, further comprising identifying a user setting associated with increasing the speed of the fan based on the determination that the suction line pressure is below the threshold pressure, wherein determining that the suction line pressure is below the threshold pressure is based on the user setting.

10. A device for controlling a heat pump system, the device comprising at least one processor coupled to memory, the at least one processor configured to:

identify a signal received from a second device associated with an outdoor portion of the heat pump system, the signal indicating that the heat pump system is performing a defrost operation;

reduce, based on the defrost operation, a speed of a fan associated with an indoor portion of the heat pump system;

identify pressure data received from a pressure sensor during the defrost operation, the pressure data indicative of a suction line pressure of the heat pump system;

determine, based on the pressure data, that the suction line pressure is below a threshold pressure during the defrost operation, the threshold pressure greater than a low-pressure fault threshold; and increase the speed of the fan based on the determination that the suction line pressure is below the threshold pressure during the defrost operation.

11. The device of claim 10, wherein to reduce the speed of the fan comprises to reduce the speed of the fan to a speed greater than zero, and wherein to increase the speed of the fan comprises to increase the speed of the fan linearly, based on the suction line pressure being below the threshold pressure during the defrost operation, to a second speed associated with a heating operation of the heat pump system.

12. The device of claim 10, wherein the at least one processor is further configured to:

determine, based on the pressure data, that the suction line pressure is above the threshold pressure; and reduce the speed of the fan based on the determination that the suction line pressure is above the threshold pressure.

13. The device of claim 10, wherein the device is an indoor thermostat device.

14. The device of claim 10, wherein the device is in the indoor portion of the heat pump system.

15. The device of claim 10, wherein the at least one processor is further configured to activate, based on the defrost operation, monitoring of the pressure data.

16. The device of claim 10, wherein the signal is received serially from the second device.

17. A system for controlling a heat pump system, the system comprising:

an outdoor portion;

an indoor portion; and at least one processor coupled to memory, the at least one processor configured to:

identify a signal received from a second device associated with the outdoor portion of the heat pump system, the signal indicating that the heat pump system is performing a defrost operation;

reduce, based on the defrost operation, a speed of a fan associated with the indoor portion;

identify pressure data received from a pressure sensor during the defrost operation, the pressure data indicative of a suction line pressure of the heat pump system;

determine, based on the pressure data, that the suction line pressure is below a threshold pressure during the defrost operation, the threshold pressure greater than a low-pressure fault threshold; and increase the speed of the fan based on the determination that the suction line pressure is below the threshold pressure during the defrost operation.

18. The system of claim 17, wherein to reduce the speed of the fan comprises to reduce the speed of the fan to a speed greater than zero, and wherein to increase the speed of the fan comprises to increase the speed of the fan linearly, based on the suction line pressure being below the threshold pressure during the defrost operation, to a second speed associated with a heating operation of the heat pump system.

19. The system of claim 17, wherein the at least one processor is in an indoor thermostat device.

20. The system of claim 17, wherein the at least one processor is in the indoor portion of the heat pump system.

* * * * *